United States Patent [19]

Davis

[11] 4,061,183

[45] Dec. 6, 1977

[54] REGENERATOR MATRIX

[75] Inventor: Leonard C. Davis, Indianapolis, Ind.

[73] Assignee: General Motors Corporation, Detroit, Mich.

[21] Appl. No.: 769,228

[22] Filed: Feb. 16, 1977

[51] Int. Cl.[2] ..... F28D 19/00

[52] U.S. Cl. ..... 165/8; 165/10; 29/157.3 R

[58] Field of Search ..... 165/8, 9, 10; 29/157.3 R

[56] References Cited

U.S. PATENT DOCUMENTS

| | | | |
|---|---|---|---|
| 1,808,921 | 6/1931 | Frankl | 165/10 |
| 2,438,851 | 3/1948 | Gates | 165/10 |
| 2,596,642 | 5/1952 | Boestad | 165/10 X |
| 3,532,157 | 10/1970 | Hubble | 165/10 X |

*Primary Examiner*—Albert W. Davis, Jr.

*Attorney, Agent, or Firm*—J. C. Evans

[57] ABSTRACT

A matrix disc for a rotary regenerator heat exchange apparatus includes a pair of spirally wound sheets, a first sheet having a continuously formed sinusoidal corrugation having a pitch dimension that accomodates thermal expansion in the strip. The first sheet is juxtaposed against a second corrugated sheet having a plurality of axial spaced corrugated segments therein having a pitch to accomodate thermal expansion and wherein each segment is interconnected by a plurality of elements including flat side wall segments having an axial length greater than the pitch dimension of abutting corrugation of the adjacent first strip and including a diagonally directed segment therebetween to space the corrugated segments of the second strip away from the first strip to define a plurality of generally rectangularly configured air form fluid flow paths in the matrix disc.

3 Claims, 4 Drawing Figures

REGENERATOR MATRIX

This invention relates to matrix discs for rotary regenerator heat exchanger apparatus and more particularly to a spirally wound, double layered corrugated metal strip matrix having air flow passages formed therethrough.

Metal matrices ordinarily are made up of crimped or corrugated metal sheets that are spirally wound into a disc and then brazed or otherwise bonded together to form a rigid, cellular or closed course structure for air flow therethrough. Such regenerators are operative in high temperature modes for example in the range of 1450° F, or higher so that the rim or radially outer most portion of the disc, which is subjected to relatively cooler air will tend to contract with respect to the interior of the disc. Other factors exist which can cause a thermal gradient across the disc so that different radial zones of the matrix will expand or contact to a greater or lesser degree relative to adjacent portions of the disc and as a result will produce differential expansion with attendant over stress and yield of segments of the spirally wound metal sheets.

Accordingly various proposals have been suggested for including corrugations in adjacent ones of spirally wound strips that make up a matrix disc construction. One such proposal for stress relief corrugations in spirally wound strip, metal matrix structures are set forth in the U.S. Pat. No. 3,276,515 for Gas Turbine Regenerator issued Oct. 4, 1966, to James H. Whitfield. In this arrangement one of the strips is a flat strip which can produce substantial stress buildups. Another example is set forth in the U.S. Pat. No. 3,532,157 entitled Regenerator Disc, issued Oct. 6, 1972 to William S. Hubble wherein the flat sheet is weakened to permit a stress relief.

The problem of matrix structures made up of two spirally wound strips is further complicated in that, as the matrix is wound spirally each turn is of a different length than the preceeding one. In the case of two corrugated strips, eventually the wound strips can be arranged in a fashion so that the peaks of corrugations on one sheet are aligned to nest in the valleys of the corrugations on an adjacent sheet thereby producing a nesting effect which can cut off air flow through the matrix.

Accordingly in U.S. Pat. No. 3,910,344 issued Oct. 7, 1975 to Robert J. Hagen two corrugations are formed with diagonally oppositely formed corrugations to prevent nesting. However, in such arrangements the flow paths through the matrix are arranged out of parallel.

Accordingly an object of the present invention is to provide an improved dual strip, spirally wound regenerator matrix of thin sheet construction having a first corrugated sheet wound with respect to a second corrugated sheet having a spacer convolution therein configured to serve as end segments of a rectangular passage that prevents flow concentration within the flow passages through a regenerator matrix and wherein the spacer convolution has flat segment portions thereon of an axial extent greater than that of the pitch of corrugations in an adjacent strip to prevent nesting of spirally wound segments of the first and second sheets in the regenerator matrix.

Another object of the present invention is to provide an improved sheet metal regenerator matrix including first and second metallic sheets one having a corrugation formed throughout the length thereof at a predetermined pitch to provide high radial and circumferential flexibility to prevent thermal distortion in the fabricated regenerator disc and a second corrugation having a plurality of axially spaced corrugated segments therein to provide high radial and circumferential flexibility to prevent thermal distortion and interposed spacer convolutions, each having spaced, parallel flat wall segments to bridge the peaks of the corrugations on an adjacent strip to prevent nesting between the first and second sheets and including a diagonal segment to separate the corrugated segments of a second sheet from corrugations in the first sheet and wherein the spacer convolutions each further includes a transverse wall portion that forms one wall of a rectangular flow passage while the diagonal segment forms an opposite wall of the rectangular flow passage to prevent flow concentrations in the matrix.

Further objects and advantages of the present invention will be apparent from the following description, reference being had to the accompanying drawings wherein a preferred embodiment of the present invention is clearly shown.

Figure 1:
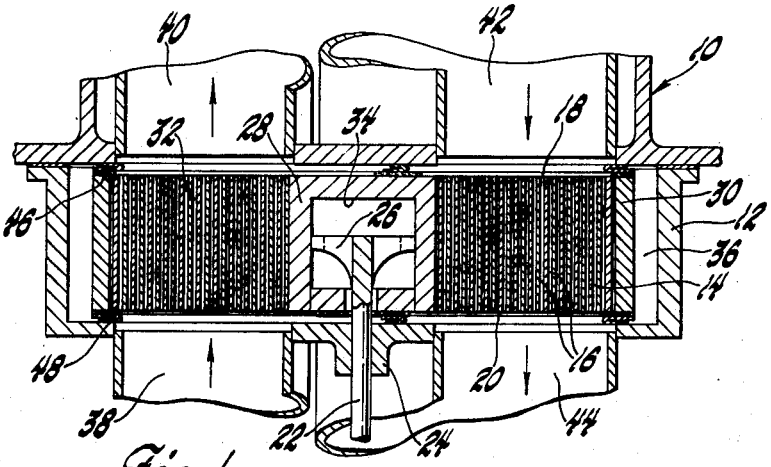
FIG. 1 is a schematic view of an axial flow rotary regenerator taken in plane containing the axis of rotation of the matrix thereof.
Figure 2:
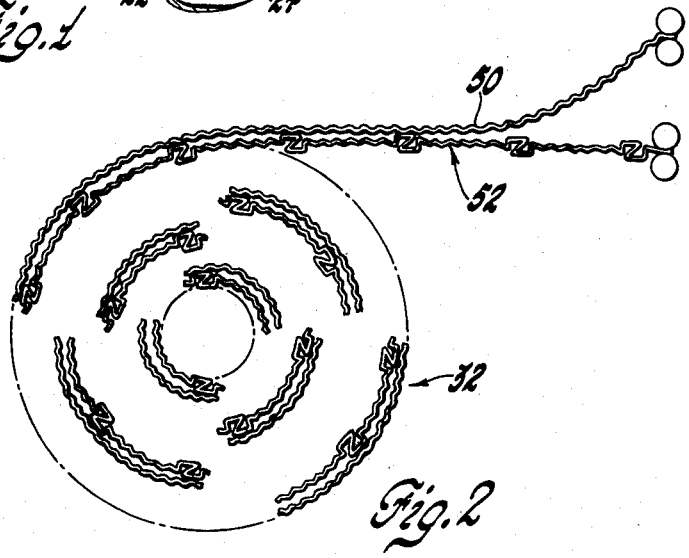
FIG. 2 is an end view of the heat exchanger material of the matrix of FIG. 1 showing spirally wound first and second sheets thereof.
Figure 3:
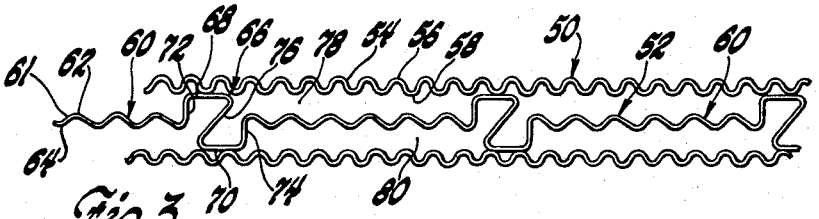
Figure 4:
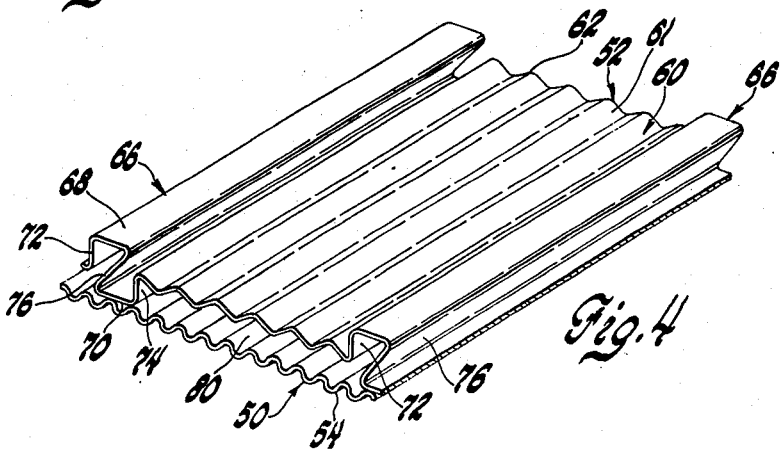

FIG. 3 is an enlarged, end view of a portion of the heat exchanger material of the matrix of FIG. 1 constructed in accordance with the invention with a stack of spirally wound first and second sheets being straightened to more clearly show the features therein; and FIG. 4 is a view in perspective of a continuously corrugated sheet component of the invention and an associated corrugated sheet with the spacer convolution configuration of the present invention.

Referring now to FIG. 1, a rotary regenerator heat exchange apparatus 10 is illustrated including a generally drum configured housing 12 having an axial flow matrix 14 enclosed therein constructed to define a multiplicity of pores or passages 16 therethrough each arranged in parallel relationship and being shown schematically greatly enlarged in FIG. 1. The passages 16 extend from an inner face 18 of the disc 14 to an outer face 20 thereof. The flow pattern is generally parallel to the axis of rotation defined by a matrix location and drive shaft 22. The shaft 22 is suitably journaled in a boss 24 of the housing 12 and terminates in a spider 26 coupled through the matrix by suitable means such as those illustrated in the U.S. Pat. No. 3,476,173 entitled Rotary Regenerator Matrix Mount and Drive issued Nov. 4, 1969 to Joseph W. Braken, Jr. et. al.

The matrix 14 includes an impervious inner rim 28 and an outer impervious rim 30 for alignment purposes and structural integrity. However, such rims are not essential to practice the present invention and porous heat exchange material 32 may be interposed therebetween having parallel faces and being pervious to flow generally parallel to the axis of the disc and impervious to flow in a radial direction in cases where the rims are omitted. The spider 26 is located in a generally cylindrical space 34 within the inner rim 28 and the outer perimeter of the construction includes an annular, radially outwardly located space 36 around the matrix 16.

The construction includes an inlet 38 for passage of cool, high pressure air into one face of the housing opposite to it an outlet 40 for the discharge of the compressed air. Inlet air is heated by passage through the matrix 14 which rotates across the aligned inlet 38 and outlet 40. Hot, low pressure exhaust gas enters through an inlet 42 and leaves the regenerator assembly through an outlet 44. Thus, the hot and cool air flow through the rotating matrix 14 is in a counter flow relationship in the illustrated embodiment of the invention. As shown, the hot gas passages are of a larger area than the cool air passages because of differences in density between the hot and cold fluids. Since the exhaust gases that enter through the inlet 42 pass through the inner face 18 of the matrix 14 this is the hot side of a construction while the outer face 20 of the matrix 16 is referred to as the cold side.

In the illustrated arrangement, a seal assembly 46 is located on the inboard face 18 of the matrix disc 14 and a like seal assembly 48 is formed on the outboard face at 20 thereof. Both assembly 46 and assembly 48 are spring biased between the faces 18, 20 of the matrix disc 14 and the housing 12 to confine the cold and hot fluids to desired flow paths having predetermined planar extents on the faces 18, 20 of the matrix 14 and to minimize leakage between the hot and cold flow passages to the regenerator assembly 10.

In accordance with the invention, the heat exchange body 32 of the matrix disc 14 is comprised of a first elongated strip 50 that is wound along with a second strip 52 in a spiral wrap around the hub 22 to produce the spirally configured heat exchange material 32 with the plurality of parallel passages 16 therethrough to define a highly porous configuration. As seen in FIGS. 3 and 4 the continuously formed first elongated strip 50 is formed with spaced apart narrow and relatively shallow corrugations 54 with a predetermined pitch between peaks 56 of 0.023 inches and with a depth between peaks 56 and 58 of 0.010 inches.

As shown in FIG. 3, two spirally wound segment portions of the elongated strip 50 are illustrated with the aforesaid corrugations being formed uniformly therein across the full width of the strip 50 throughout its length.

The second elongated strip 52 serves both as a spacer and as a further extension of the corrugated pattern of the overall wall portions of the heat exchange material 32. More particularly the elongated strip 52 has a plurality of axial spaced corrugated segments 60 which in one working embodiment of the invention, included a corrugation 61 with a pitch between adjacent peaks 62 of 0.030 inches. Each of the corrugations in the segments 60 have a depth between the peak 62 and an opposed peak 64 of 0.010 inches.

As in the case of the corrugations 54 the corrugations in the segments 60 serve as a flexible configuration to compensate for differential thermal expansion in the disc 14.

As shown in FIG. 4, both the corrugations 54 and the corrugations 61 in the segment 60 are parallel to the inlet and outlets of the apparatus 10 and extend completely across the width of the separate strips 50, 52 and as such afford a highly efficient means to compensate thermal temperature differences in the disc.

A further feature of the present invention is that while the parallel and transverse characteristics of the corrugation 54, 61 are maintained this is accomplished in a spirally wound matrix disc without sacrificing fluid flow patterns through the disc between the inlet and outlets of the apparatus 10.

More particularly, flow efficiency is maintained with a rectangularly configured opening between adjacent segments of the disc. Accordingly the second elongated strip 52 in addition to the axially spaced, corrugated segments 60 includes a plurality of interposed, spacer convolutions 66 therein. Each spacer convolution 66 includes spaced, parallel flat wall segments 68, 70 having a length greater than that of the pitch between the peaks of the corrugations 54 on the first strip 50 to prevent nesting of the second strip 52 with respect to the corrugations of the first strip 50. Furthermore each spacer convolution 66 includes a pair of transverse wall segments 72, 74 that serve as means for spacing the corrugated segment 60 of the second strip 52 at precisely the midpoint relationship with the adjacent wound segments of the first strip 50 as seen in FIG. 3.

Each spacer convolution 66 further includes a diagonal segment 76 that joins each of the flat wall segments 68, 70 to serve as a means to compensate for thermal distortion and to maintain a generally rectangularly configured space 78, 80 which defines the passages 16 through the matrix 14.

More particularly, each of the spaces 78 is bounded on one side thereof by one of the transverse wall segments 72 and the diagonal segment 76 or in the case of the rectangular space 80 by the wall segment 74 and the diagonal segment 76 of the next adjacent spacer convolution 66.

The arrangement produces an accurate spacing to maintain rectangularly configured flow passages having a high effectiveness because of an improved hydraulic radius.

Furthermore, the illustrated arrangement enables the separate corrugated strips 50, 52 to be easily spirally wound without concern for nested corrugations due to change in length of each of the wound portions in the spiral. The flat segment 68, 70 of the specially configured spacer convolution 66 results in a nonnesting pattern and accurate spacing so that the hydraulic radius of the flow passages can be maintained for maximum flow effectiveness.

Furthermore, the spacer convolution 66 is configured to act as an extension of the rectangular passages thereby to avoid flow concentrations at the interface between the wound strips. Furthermore, the pitch between the corrugations 54 in the strip 50 and the corrugated segments 60 in the strip 52 differ to avoid flow concentrations through the matrix 14.

While the embodiments of the present invention, as herein disclosed, constitute a preferred form, it is to be understood that other forms might be adopted.

The embodiments of the invention in which an exclusive property or privilege is claimed are defined as follows:

1. A sheet matrix for a gas turbine engine regenerator disc comprising first and second sheets spirally wound to form a disc, said first sheet having first corrugations formed transversely thereacross with a predetermined pitch dimension, said second sheet having corrugated segments formed transversely thereof at spaced axial points of said second sheet, said second sheet having spacers with parallel segments engageable with the peaks of said first corrugations on adjacent spirally wound portions of said first sheet, each of said parallel segments having a length greater than that of the pitch dimension of said first corrugations to prevent nesting of adjacent wraps of the spirally wound first and second sheets, each of said spacers further including a transversely formed portion defining a first side wall of a flow passage through said first and second sheets, each of said spacers including a second side wall on the opposite side of said passage from said first side wall.

2. A sheet matrix for a gas turbine engine regenerator disc comprising first and second sheets spirally wound to form the disc, said first sheet having first corrugations formed transversely thereacross with a predetermined pitch dimension, said second sheet having corrugated segments formed transversely thereof at spaced axial points of said second sheet, said second sheet having spacers with parallel segments engageable with the peaks of said first corrugations on adjacent spirally wound portions of said first sheet, each of said parallel segments having a length greater than that of the pitch dimension of said first corrugations to prevent nesting of adjacent wraps of the spirally wound first and second sheets, each of said spacers further including a transversely formed portion defining a first side wall of a flow passage through said first and second sheets, each of said spacers including a second side wall on the opposite side of said passage from said first side wall, said second side wall having a depth approximately one-half of said first side wall to avoid flow concentration and restriction within said passage.

3. A sheet matrix for a gas turbine engine regenerator disc comprising first and second metallic sheets having a wall thickness of less than 0.004 inches spirally wound to form a disc, said first metallic sheet having first corrugations formed transversely thereacross with a predetermined pitch dimension, said second metallic sheet having corrugated segments formed transversely thereof at spaced axial points of said second sheet, said second metallic sheet having spacers with parallel segments engageable with the peaks of said first corrugations on adjacent spirally wound portions of said first metallic sheet, each of said parallel segments having a length greater than that of the pitch dimension of said first corrugations to prevent nesting of adjacent wraps of the spirally wound first and second metallic sheets, each of said spacers further including a transversely formed portion defining a diagonal side wall of a flow passage through said first and second metallic sheets, each of said spacers including a second side wall on the opposite side of said passage from said diagonal side wall, said second side wall having a depth approximately one-half of said diagonal side wall to avoid flow concentration and restriction within said passage.

* * * * *